US011993436B2

(12) United States Patent
Erwin

(10) Patent No.: US 11,993,436 B2
(45) Date of Patent: May 28, 2024

(54) CONTAINER CLOSURE

(71) Applicant: ALPLA WERKE ALWIN LEHNER GMBH & CO. KG, Hard (AT)

(72) Inventor: Mayer Erwin, Eisgarn (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 98 days.

(21) Appl. No.: 17/604,338

(22) PCT Filed: Apr. 15, 2020

(86) PCT No.: PCT/EP2020/060597

§ 371 (c)(1),
(2) Date: Oct. 15, 2021

(87) PCT Pub. No.: WO2020/212426

PCT Pub. Date: Oct. 22, 2020

(65) Prior Publication Data

US 2022/0194673 A1 Jun. 23, 2022

(30) Foreign Application Priority Data

| | | |
|---|---|---|
| Apr. 15, 2019 | (CH) | 00516/19 |
| Nov. 20, 2019 | (CH) | 01467/19 |
| Dec. 23, 2019 | (CH) | 01695/19 |

(51) Int. Cl.

| | |
|---|---|
| ***B65D 55/16*** | (2006.01) |
| ***B65D 1/02*** | (2006.01) |
| ***B65D 41/34*** | (2006.01) |

(52) U.S. Cl.
CPC ..... *B65D 55/16* (2013.01); *B65D 1/0246* (2013.01); *B65D 41/3428* (2013.01)

(58) Field of Classification Search
CPC ..... B65D 55/16; B65D 2401/30; B65D 41/3428; B65D 2251/1008;
(Continued)

(56) References Cited

U.S. PATENT DOCUMENTS 4,394,918 A * 7/1983 Grussen ..... B65D 41/3428 215/253
5,913,437 A * 6/1999 Ma ..... B65D 41/3428 215/329
(Continued)

FOREIGN PATENT DOCUMENTS

DE 10342407 A1 9/2004
WO 0026108 5/2000
(Continued)

*Primary Examiner* — Steven A. Reynolds
*Assistant Examiner* — Prince Pal
(74) *Attorney, Agent, or Firm* — MORISS O'BRYANT COMPAGNI CANNON, PLLC

(57) ABSTRACT

A closure cap for closing a pouring opening of a container has a cylindrical threaded part with an open rim, an inner thread configured to cooperate with an outer thread of a container neck, a security ring configured to be held on a projection formed on the container neck, a plurality of security webs configured to releasably connect the security ring to the open rim, and a first retaining strip having a first end securely connected to the open rim of the threaded part and a second end securely connected to the security ring. The closure cap has a second retaining strip having a third end securely connected to the open rim of the threaded part and a fourth end securely connected to the security ring. A circular web section is formed between the first and the second ends. A second projection is formed on an outer wall of the web section.

26 Claims, 6 Drawing Sheets

Figure 1:
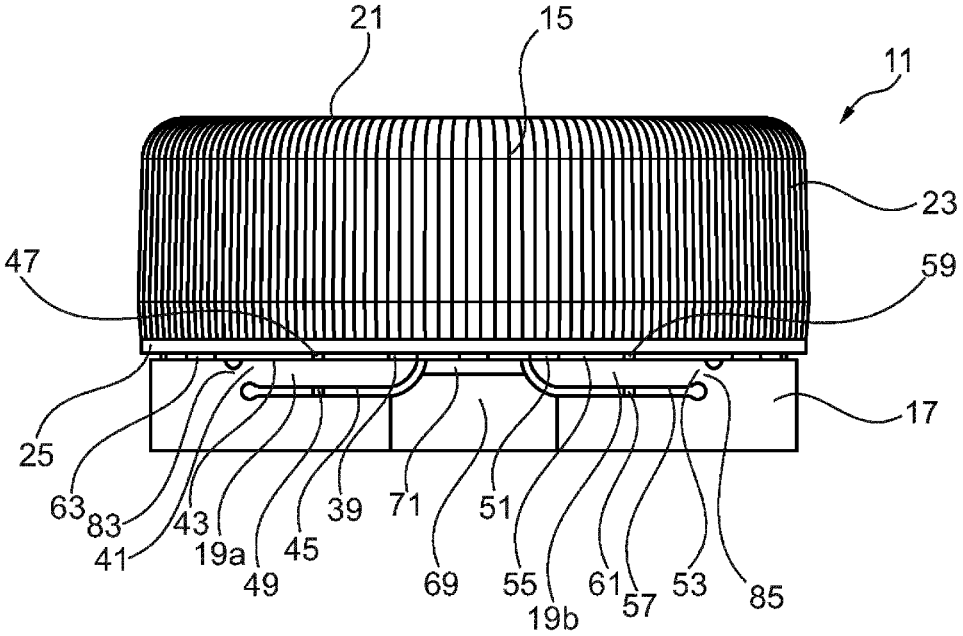

(58) Field of Classification Search
CPC ..... B65D 41/3447; B65D 41/325; B65D 1/0246; B65D 41/34; B65D 2401/20; B65D 2401/15; B65D 41/3423; B65D 41/48; B65D 2251/023; B65D 2251/10; B65D 2401/50; B65D 41/3409; B65D 41/3442; B65D 43/16; B65D 47/0823; B65D 2251/0021; B65D 2251/0037; B65D 2251/01; B65D 2251/04; B65D 2251/1016; B65D 2401/00
USPC ..... 215/252, 253, 258, 243, 329, 44; 220/375, 263, 810, 836
See application file for complete search history.

(56) References Cited

U.S. PATENT DOCUMENTS 6,112,923 A * 9/2000 Ma ..... B65D 41/3428 215/44
6,474,491 B1 * 11/2002 Benoit-Gonin .... B65D 41/3428 220/263
8,469,213 B2 * 6/2013 Ishii ..... B65D 41/3428 220/837
10,836,544 B2 * 11/2020 Kim ..... B65D 41/3428
11,505,372 B2 * 11/2022 Bloom ..... B65D 41/3409
2011/0114593 A1 * 5/2011 Ishii ..... B65D 41/325 215/253
2011/0174760 A1 * 7/2011 Luzzato ..... B65D 41/48 215/258
2018/0170625 A1 * 6/2018 Sung ..... B65D 41/34
2019/0071222 A1 * 3/2019 Druitt ..... B65D 41/34
2020/0115115 A1 * 4/2020 Migas ..... B65D 55/16
2020/0189805 A1 * 6/2020 Scherer ..... B65D 41/005
2020/0207525 A1 * 7/2020 Sung ..... B65D 43/0231
2020/0369446 A1 * 11/2020 Mélan-Moutet ... B65D 41/3447
2020/0399036 A1 * 12/2020 Dai ..... B65D 41/325
2021/0039841 A1 * 2/2021 Pucci ..... B29D 99/0096
2021/0094733 A1 * 4/2021 Bloom ..... B65D 41/3442
2021/0122532 A1 * 4/2021 Dreyer ..... B65D 41/3447
2021/0221572 A1 * 7/2021 Migas ..... B65D 41/3428
2021/0229873 A1 * 7/2021 Berroa García ... B65D 41/3447
2021/0300648 A1 * 9/2021 Bassi ..... B65D 41/34
2021/0354883 A1 * 11/2021 Ferrari ..... B65D 55/16
2022/0073238 A1 * 3/2022 Naumann ..... B65D 41/3447
2022/0081171 A1 * 3/2022 Erwin ..... B65D 41/3428
2022/0185554 A1 * 6/2022 Falzoni ..... B65D 41/3447
2022/0204228 A1 * 6/2022 Bassi ..... B26F 1/18
2022/0267052 A1 * 8/2022 Dreyer ..... B65D 41/3447
2022/0289441 A1 * 9/2022 Zangerle ..... B65D 41/3428
2023/0025075 A1 * 1/2023 Leuenberger ..... B65D 55/024
2023/0034260 A1 * 2/2023 Omori ..... B65D 41/3428
2023/0041392 A1 * 2/2023 Dangl ..... B65D 41/3447
2023/0042976 A1 * 2/2023 Kainz ..... B65D 55/16
2023/0056087 A1 * 2/2023 Graux ..... B65D 55/16

FOREIGN PATENT DOCUMENTS

WO 2009002057 A2 12/2008
WO 2010004919 A1 1/2010

* cited by examiner

CONTAINER CLOSURE

CROSS-REFERENCE TO RELATED APPLICATIONS

This application is a national phase entry under 37 U.S.C § 371 of PCT/EP2020/060597 filed Apr. 15, 2020, which claims priority to Swiss Patent Application No. 00516/19 filed Apr. 15, 2019, and Swiss Patent Application No. 01467/19 filed Nov. 20, 2019, and Swiss Patent Application No. 01695/19 filed Dec. 23, 2019, the entirety of each of which is incorporated by this reference.

FIELD OF THE INVENTION

The invention relates to a closure cap for closing a container, and to a container having such a closure cap.

PRIOR ART

Closure caps which are captively held on the container and close the pouring opening thereof are known from the prior art in the field of plastic closure caps having a security ring. Closure caps are also known which have two retaining strips, which connect a threaded part of the closure cap to a security ring of the closure cap. The two retaining strips can act as a hinge on which the threaded part can be folded away from the security ring or from the container to be closed.

Such a closure cap is known from WO 2010/004919 A1. The retaining strips each have an inclined section, the angle of inclination of which gradually decreases with respect to a vertical line when the threaded part is moved upwards with respect to the security ring. As a result, the retaining strips can act as a hinge. A projecting piece is formed on the open rim of the threaded part and projects downwards. When the threaded part is in the unfolded position, the projecting piece comes into contact with a claw section of the container neck, which claw section holds the security ring on the container neck. The projecting piece holds the threaded part in the unfolded position and prevents the threaded part from being an obstacle when pouring out a product contained in the container.

WO 00/26108 A1 discloses a similar closure. Two arms in the form of a circular arc are formed on the security ring. Each arm is connected, on the one hand, to the closure by means of a film hinge and a bendable region, and, on the other, to the security ring. The hinge effect is thereby realized by the two arms. A tab is formed on the lateral skirt of the closure cap and can be supported on the container neck when the closure cap is in the folded position. The closure cap is held in the unfolded position by the tab.

However, these solutions of the prior art have the disadvantage that the projecting piece or the tab are cut out of the security ring, and the security ring is thereby weakened. This weakening of the security ring can cause damage to the security ring when the closure is pressed onto the container neck. This area of weakness can also facilitate an undesired release of the security ring—for example, by manipulation or mechanical action. As a result, the security ring, in cooperation with the security webs, can no longer fulfill the task of indicating whether or not the closure has already been opened. Lastly, projections on the closure cap are not user-friendly, since they can break off or jam during operation.

Advantages of the Invention

The present invention provides a container closure that does not have the above disadvantages, and is reliably held in its unfolded position on the container neck.

SUMMARY OF THE INVENTION

The stated aim for a closure cap for closing a container is achieved by the features listed in the independent claims. The dependent claims set out developments and/or advantageous alternative embodiments.

The invention includes a second projection that is formed on the outer wall of the web section, and the open rim, when in the open position, comes into contact with the second projection. The threaded part is therefore free of a retaining projection which holds the threaded part on the container neck in the open position, as proposed in the prior art. The holding projection according to the prior art must be cut out of the security ring, whereby it is inevitably weakened. Contrastingly, according to the invention, a second projection can be formed on the web section, with which projection the open rim of the threaded part comes into contact and is held thereon in the open position. As a result, the web section does not have a weakening and may be the same height as the security ring. As a result, the closure cap has sufficient stability to be able to be pressed onto the container neck without being destroyed. After the container is filled, the closure cap can therefore be placed on the container neck mechanically and, accordingly, quickly by being pressed on. Furthermore, the threaded part is free of projections, as a result of which catching or jamming due to a projection of the threaded part is prevented during use of the threaded part. As a result, the threaded part is more user-friendly than threaded parts according to the prior art.

In one embodiment of the invention, the second projection is formed on the rim, facing the threaded part, of the security ring. As a result, the threaded part, when in the open position, is unfolded as far as possible and does not interfere with the use of the container. Since the threaded part in the open position can be unfolded at most until it comes into contact with the support ring of the container, the opening angle is, for geometric reasons, greatest if the second projection is as far away as possible from the support ring. By contacting the support ring when in the open position, the holder becomes more stable, since there are two support points.

It has proven expedient for the second projection to be a step projecting radially outwards. As a result, the open rim of the threaded part, when in the open position, can stably snap into the transition of the second projection to the container neck. It is also conceivable for the second projection to be oriented obliquely downwards in the direction of the container in order to enhance the holding effect of the threaded part. The second projection may have the same length as the web section. However, it would also be conceivable for the length of the second projection to be shorter than the length of the web section.

It has proven to be advantageous if the second projection has a height of between 1 and 4 mm or between 2 and 3 mm. This height is sufficient to keep the threaded part stable in the open position, and the open rim therefore does not slip over the second projection. On the other hand, the height is not so high that the first and second retaining strips would have to be stretched in order to draw the open rim over the second projection.

In a further embodiment of the invention, the first and the third ends enclose a first opening angle of at least 15 degrees and at most 40 degrees or at least 20 and at most 25 degrees, with respect to the center point of the closure cap as the apex, and the second and the fourth ends enclose a second opening angle of at least 220 degrees and at most 270 degrees, or at least 240 and at most 260 degrees, with respect to the center point of the closure cap as the apex. By selecting these angle sizes, the first and second retaining strips are arranged on the security ring in a position in which they extend substantially tangentially along the container neck when the threaded part is in the open position. As a result, the retaining strips move with the threaded part without catching on the container neck when the threaded part is moved into the open position.

Usefully, the opening angle, which encloses the web section with the center point as the apex, substantially corresponds to the first opening angle. The web section may be formed by cutting out the first and second retaining strips from the security ring. It would also be conceivable for a greater distance to be provided between the first end of the first retaining strip and the web section or the third end of the second retaining strip and the web section than if the distance were formed by cutting out the retaining strips.

The first and second ends may enclose a third opening angle of at least 30 degrees and at most 60 degrees or at least 40 and at most 50 degrees, with respect to the center point of the closure cap as the apex.

The third and the fourth ends may also enclose a fourth opening angle of at least 30 degrees and at most 60 degrees or of at least 40 and at most 50 degrees, with respect to the center point of the closure cap as the apex. With this selection of the third and fourth opening angles, the first and second retaining strips have a length which allows unscrewing, transferring the threaded part into the open position, and holding the threaded part in the open position. In combination with the first and second opening angles, the retaining strips attain the appropriate position on the security ring to allow the protruding movements of the threaded part.

Usefully, the third and the fourth opening angles are of equal size, as a result of which the first and the second retaining strips are of equal length. Consequently, the threaded part is held in the second position with uniform tension.

Since the first, second, third, and fourth opening angles have a circle center point as the apex, their angular sum must be 360 degrees.

In another embodiment of the invention, the length of the first and second retaining strips is dimensions in such a way that they are tensioned in the open position, and the threaded part is held in the open position. The retaining strips may be elastically tensioned, as a result of which the threaded part can be moved multiple times between the closed position and the open position. The tension of the retaining strips allows the threaded part to be held wobble-free in the open position.

In a further embodiment of the invention, the cross-section of the first and second retaining strips is constant along the length of the first or second retaining strip. As a result, the retaining strips have constant elastic properties along their length, as a result of which a defined length of the retaining strips can be determined in which the threaded part can be held in its open position in a stable and wobble-free manner on the security ring. In the open position, the first and second retaining strips are pretensions. The elastic pretensioning of the retaining strips makes it possible for the threaded part to be unscrewed from the container neck several times and rescrewed thereon, and to be reliably held multiple times in the open position. The constant cross-section of the retaining strips along their length prevents the retaining strips from overextending in the open position, in which event the elastic properties of the retaining strips can be lost.

In a further embodiment of the invention, a first or a second narrowing of the cross-section of the first or the second retaining strip is provided at the second or the fourth end, as a result of which the second or the fourth end can act as an articulation. The movement of the first and second retaining strips during the transfer of the threaded part from the closing position into the open position is facilitated by this articulation function or defined in a direction of rotation. It is also conceivable for the first and third ends to have an articulation function so that the first and the second retaining strips can be moved like a lever with two pivot points during the movement of the threaded part. For example, the first and third ends can be fastened to the open rim in a bendable manner.

The security webs may be arranged at uniform intervals along the open rim. The security ring is therefore held on the threaded part in a sufficiently stable manner that the closure cap can be pressed onto the container neck. The threaded part can also be unscrewed with uniform force due to the uniform distances between the security webs.

The first, second, third, and fourth predetermined breaking webs are, expediently, arranged at uniform intervals along the first and second or the third and fourth rims. As a result, the closure cap is sufficiently stable even in the region of the first and second retaining strips to be able to be pressed onto the container neck. In addition, the broken predetermined breaking webs and security webs show that the threaded part has already been twisted in relation to the container neck and is no longer originally closed.

A first and second recess for receiving the first and second retaining strips is, expediently, provided on the rim, facing the first and second retaining strips, of the security ring. As a result, the first and second retaining strips can be formed from the security ring in a space-saving manner and without additional material expenditure. For example, the first and second retaining strips can be cut out of the security ring or formed during the production process of the closure cap.

In a further embodiment of the invention, the first and/or the second ends of the first retaining strip and the third and/or the fourth ends of the second retaining strip are bendable along predefined bending lines. As a result, the first and second retaining strips can each act as a lever with two pivot points. The bending lines also make it possible for the first and second retaining strips not to be bent or kinked at random positions in the open position, but, rather, precisely at the bending lines. As a result, the threaded part is held particularly precisely in the open position by the two retaining strips and is guided exactly into the open position by the two retaining strips.

In a further embodiment, a groove for receiving a support ring formed on the container neck is provided on the first cylindrical shell of the closure cap when the threaded part is in the open position. The threaded part is held stably in the open position by the groove, into which a section of the support ring snaps. The first and the second retaining strips may be slightly tensioned in the open position. When providing the groove, the closure cap can be free of the second projection. The closure cap can also have the second projection and the groove. Then, the threaded part is held even more stably in the open position, since it is held by the second projection and the support ring. In this case, it is necessary for the second projection to have a sufficient height that it can come into contact with the open rim in the open position. The threaded part is held in a force and form fit on the support ring and on the security ring.

The groove is, expediently, oriented to be substantially parallel to the open rim, wherein the groove has the shape of a straight depression. Such a groove shape can be produced with little effort, since the forming tool can be designed relatively easily, and the closure cap can be easily demolded therefrom.

In a further embodiment, a plurality of ribs, the length of which extends in the axial direction and the height of which extends in the radial direction of the threaded part, is formed on the outside of the first cylindrical shell. The provision of the groove requires a thickness of the threaded part which is greater than the depth of the groove. Threaded parts with ribs, which are known from the prior art, are particularly suitable for providing the groove as a result of their increased thickness.

The groove is, advantageously, realized in that a U-shaped depression is provided in each case on adjacent ribs, wherein the depth of the respective depression on the adjacent ribs decreases to both sides, starting from a central rib. This shape of the depressions allows for the simplified production described above.

It has proven to be expedient if an inner cone projecting inwardly is formed on the bottom of the threaded part, e.g., in the form of a sealing cylinder or a sealing ring, which is designed to cooperate in a sealing manner with the inner wall of the container neck in the closed position. The closure cap can therefore act as a so-called cone sealer and reliably seals the bottle neck.

In a further embodiment of the invention, the retaining strip has a width between 3 mm and 7 mm or a width between 4 mm and 5 mm. This dimensioning has the effect that the retaining strip is not unintentionally torn off—in particular, when the predetermined breaking webs are torn off. Furthermore, the closure cap does not become too high and can be joined in a sealing manner with standardized container necks having an outer thread.

The i closure cap is designed to cooperate with a standardized container neck having an outer thread and annular projection. The closure cap can therefore be placed on standardized container necks—in particular, PET beverage bottles. Containers that are joined to the closure cap according to the invention therefore do not have to be specifically adapted to the closure cap.

The closure cap is, expediently, made of a plastic material, such as HDPE (high-density polyethylene) or PP (polypropylene). The closure cap can therefore be produced with standard plastic materials from which known closure caps with a security ring are also produced.

In a further embodiment of the invention, the threaded part, the security ring, the retaining strip, and the at least one, first and second, predetermined breaking element are produced in one piece. As a result, the closure cap can be produced in an injection mold, without further processing steps being necessary to form the first and second retaining strips. The inner cone may also be produced in one piece together with the other parts of the closure cap.

In another embodiment of the invention, the security ring has slots with an upper edge and a lower edge arranged to be distributed over the circumference, wherein the upper edge is formed by a circular-arc-shaped section of the security ring, and the lower edge is formed by a wall section inclined inwardly in the radial direction, and the lower edge of each slot forms the projections which form engaging means for form-fitting engagement with the annular projection. Since the engaging means in the form of the inwardly-inclined wall sections are not entirely on the security ring, and slots are also present whose shape further reduces the material usage, the material requirement for plastic can be significantly reduced by up to 5%. In addition, the wall section cannot be moved inwards in the radial direction, whereby the security ring is held on the annular projection and cannot be pulled over it until the security ring is stretched along its circumference. The security ring is securely held on the annular projection by the wall sections such that the predetermined breaking elements safely tear before the holding of the wall sections is overcome. However, the wall sections are flexible or movable in an outward radial direction. As a result, the wall sections can be demolded from the injection mold or the injection-molding tool with little exertion of force. For the same reason, the application force for pressing on the container closure is significantly reduced in comparison to the prior art. Expansion of the security ring, which can lead to permanent damage to the closure cap, is largely prevented during demolding and pressing.

A further aspect of the invention relates to a container having a container body, a container neck adjoining the container body, an outer thread formed on the container neck, and a closure cap in accordance with the above description.

In another embodiment of the invention, a support ring is formed at the transition from the container neck to the container body, and the threaded part in its open position is in contact with the second projection and the support ring. Due to the additional contact on the support ring in the open position, the holder becomes more stable, since two support points are present.

In another embodiment of the invention, the support ring is accommodated in the groove in the open position, and the threaded part is thereby held in a form and force fit on the second projection and the support ring. In this variant, the threaded part is held in the open position in a particularly stable manner. However, it is also conceivable for only the groove to be provided in the closure cap, or for only the second retaining projection or step to be provided, i.e., either the second retaining projection or the groove.

BRIEF DESCRIPTIONS OF THE DRAWINGS

Figure 2:
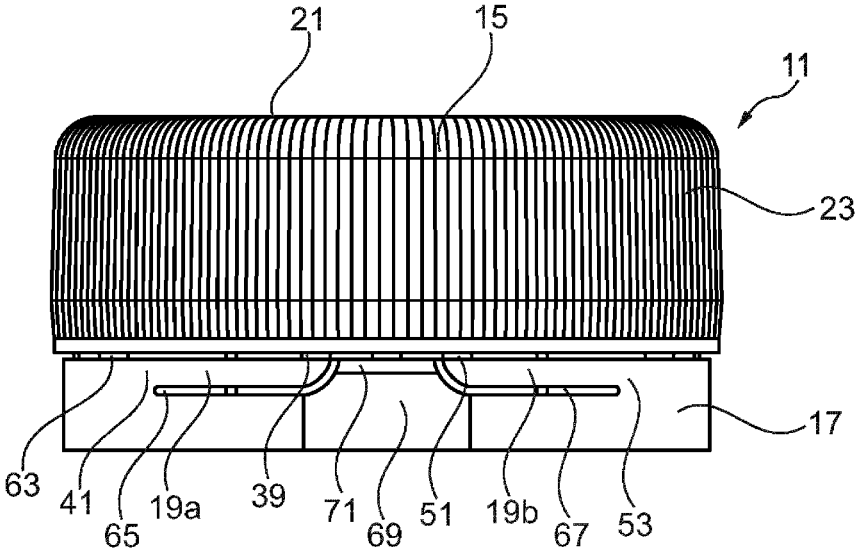
Figure 3:
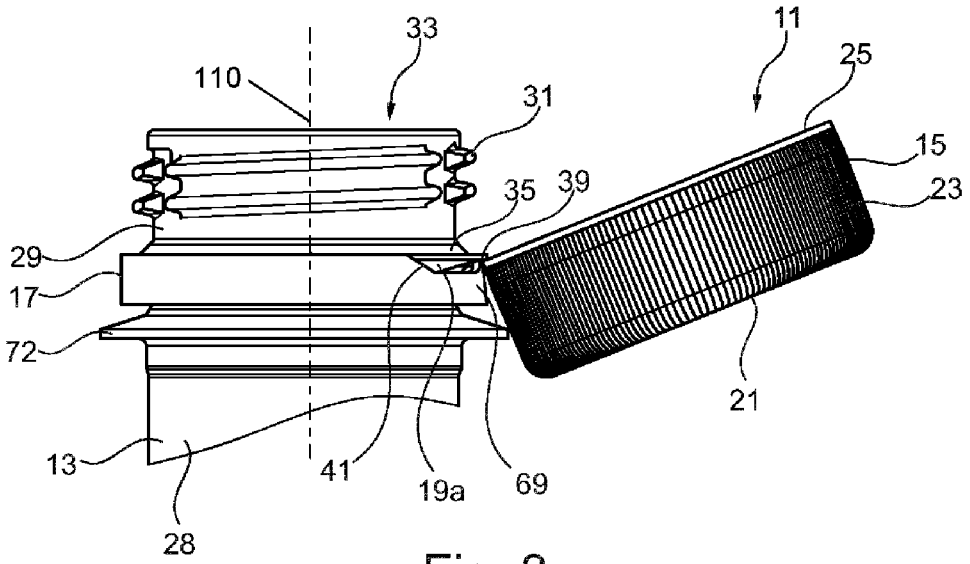
Figure 4:
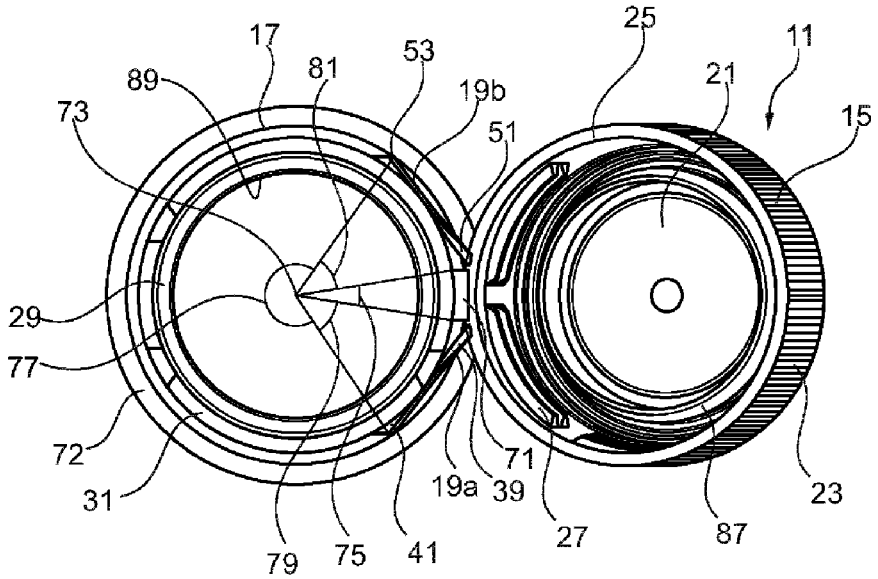
Figure 5:
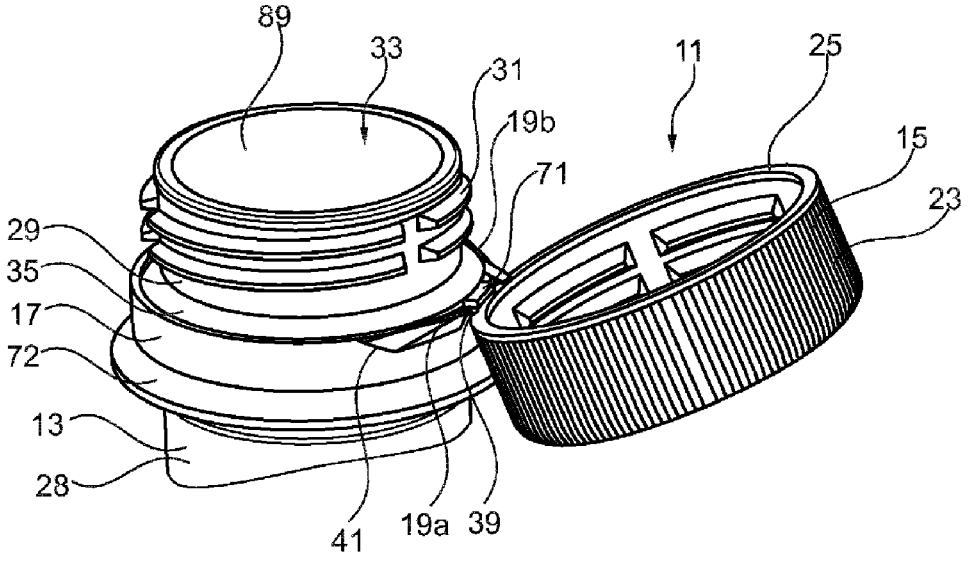
Figure 6:
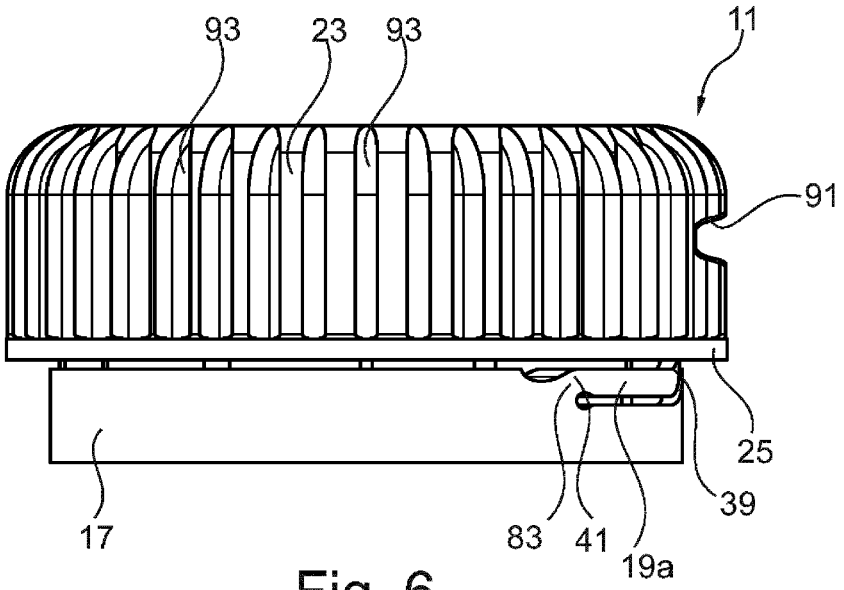
Figure 7:
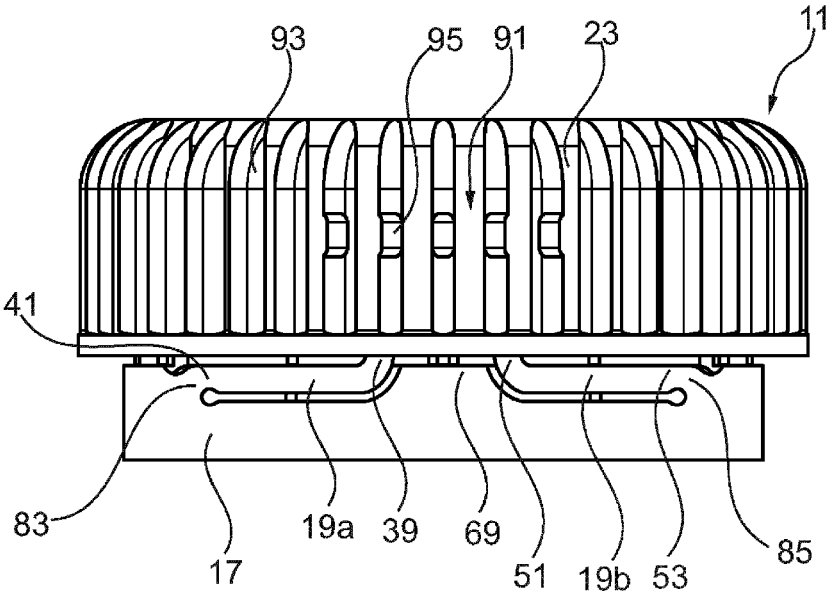
Figure 8:
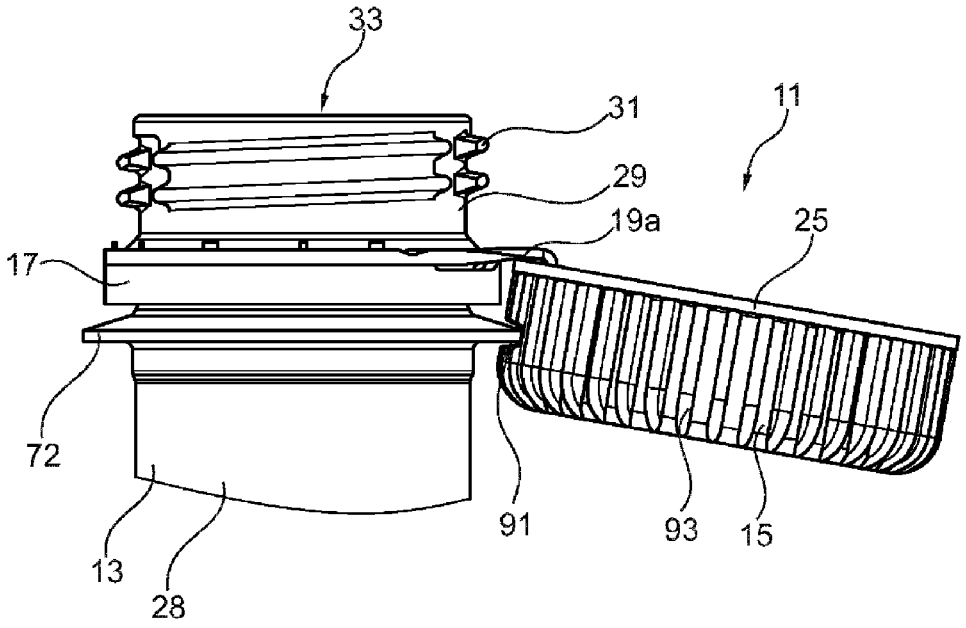
Figure 9:
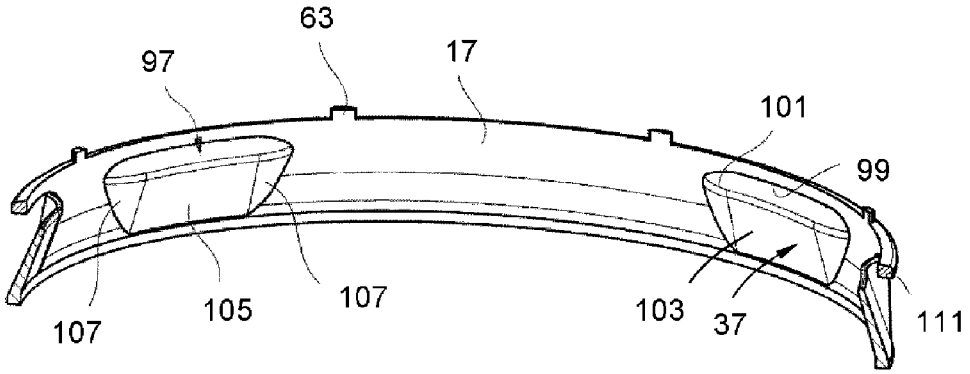

Further advantages and features become apparent from the following description of three exemplary embodiments of the invention with reference to the schematic drawings. Shown, in a representation not true-to-scale, are:

FIG. 1: a side view of a closure cap in a first embodiment, wherein the closure cap is in a closing position;

FIG. 2: a side view of a closure cap in a second embodiment, wherein the closure cap is in a closing position;

FIG. 3: a side view of the closure cap from FIG. 2 and a container neck, wherein the closure cap is in an open position;

FIG. 4: a plan view of the closure cap of FIG. 3;

FIG. 5: an isometric view of the closure cap and the container neck of FIG. 3;

FIG. 6: a side view of the closure cap in a third embodiment, wherein a groove is provided in the threaded part of the closure cap;

FIG. 7: a second side view of the closure cap of FIG. 6;

FIG. 8: a side view of the closure cap according to the third embodiment, wherein the closure cap is in an open position;

FIG. 9: a detailed view of the security ring in a further embodiment; and

Figure 10:
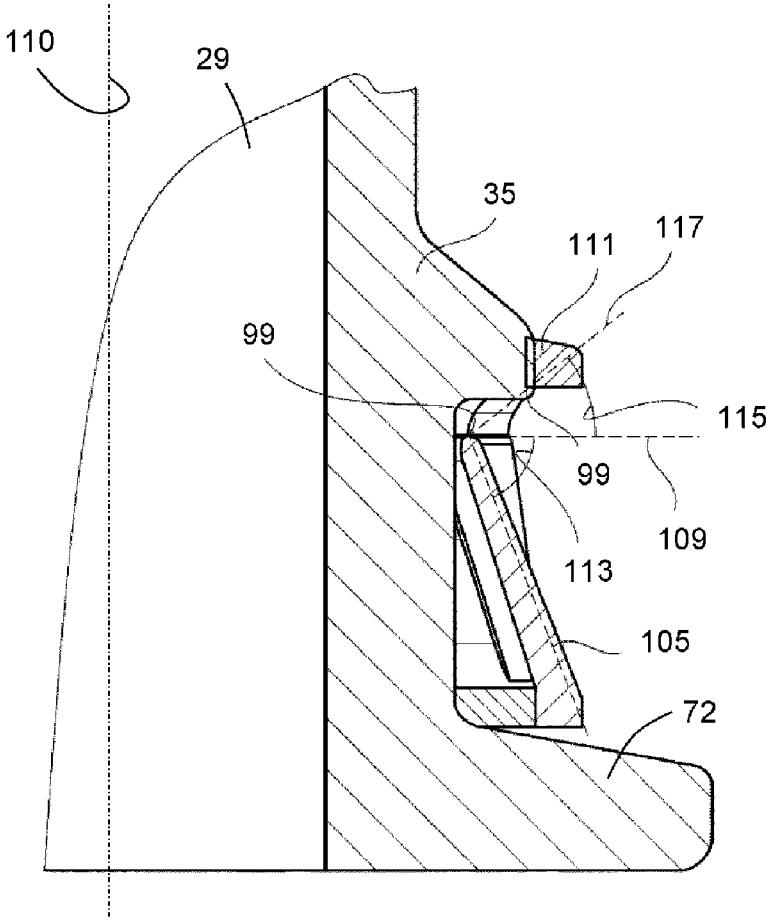

FIG. 10: a sectional view of the security ring of FIG. 9 with visualized angles of inclination.

DETAILED DESCRIPTION

FIGS. 1 through 8 show a closure cap which is denoted as a whole by reference sign 11. The closure cap 11 is captively held on a container 13—in particular, on a bottle 13. The container 13 is indicated in FIGS. 3 through 5. The closure cap 11 comprises a cylindrical threaded part 15, a security ring 17, and a first and a second retaining strip 19*a*, 19*b*. The first and second retaining strips 19*a*, 19*b* are circular and formed from the security ring 17.

The threaded part 15 comprises a bottom 21 and a first cylindrical shell 23 having an open rim 25. An inner thread 27 is formed on the inside of the shell 23. The container 13 comprises a container body 28 and a container neck 29 adjoining the container body 28. The container neck 29 is designed as a second cylindrical shell. An outer thread 31 is formed on the container neck 29 and cooperates with the inner thread 27. As a result, the threaded part 15 can be screwed onto and off the container neck 29. The closure cap 11 closes the pouring opening 33 which is provided within the container neck 29.

The security ring 17 is held in a form fit on the container neck 13. For this purpose, a first annular projection 35 is formed on the outside of the container neck 29 and can be engaged from below by projections 37 formed on the inside of the security ring 17 (FIGS. 9 and 10). The security ring 17 is rotatable in relation to the container neck 29.

The first retaining strip 19*a* has a first end 39 and a second end 41. The first end 39 is securely connected to the open rim 25. The second end 41 is securely connected to the security ring 17. As a result, the closure cap 11 is captively held on the container 13. Furthermore, the first retaining strip 19*a* has a first rim 43 and a second rim 45. The first rim 43 is connected to the open rim 25 by at least one, first, predetermined breaking web 47, and the second rim 45 is detachably connected to the security ring 17 by at least one, second, predetermined breaking web 49.

The second retaining strip 19*b* has a third end 51 and a fourth end 53. The third end 51 is securely connected to the open rim 25. The fourth end 53 is securely connected to the security ring 17. As a result, the closure cap 11 is, additionally, captively held on the container 13. Furthermore, the second retaining strip 19*b* has a third rim 55 and a fourth rim 57. The third rim 55 is connected to the open rim 25 by at least one, third, predetermined breaking web 59, and the fourth rim 57 is detachably connected to the security ring 17 by at least one, fourth, predetermined breaking web 61.

In addition, the security ring 17 is held at the open rim 25 by a plurality of security webs 63. The security webs are arranged at uniform intervals on the security ring 17. It goes without saying that the regions occupied by the first and the second retaining strips 19*a*, 19*b* on the security ring 17 are free of security webs 63.

The first and the second retaining strips 19*a*, 19*b* have a width between 4 mm and 5 mm so that they are sufficiently stable.

According to FIG. 1 or 2, the threaded part 15 is in a closed position in which it is pressed or screwed onto the container neck 29. When unscrewing from the container neck 29, the first and second retaining strips 19*a*, 19*b* are pulled upwards in an axial direction and are also elastically stretchable if necessary, so that the threaded part 15 can be unscrewed and folded away from the container neck 29.

A first and a second recess 65, 67 are provided on the security ring 17. The first and the second retaining strips 19*a*, 19*b* are accommodated in the first or the second recess 65, 67. This makes it possible to design the first and second retaining strips 19*a*, 19*b* directly from the security ring 17—for example, by being cut out of the security ring.

A circular-arc-shaped web section 69, which has the height of the security ring 17, is formed between the first end 39 of the first retaining strip 19*a* and the third end 51 of the second retaining strip 19*b*. A second projection 71 is formed at the rim of the web section 69 which faces the open rim 25. The second projection 71 has the shape of a step projecting radially outwards. The step has a height of 2 to 3 mm.

When the threaded part 15 is transferred from its unscrewed position into its open position, the first and second retaining strips 19*a*, 19*b* act as a hinge on which the threaded part can be unfolded into the open position. The length of the first and second retaining strips 19*a*, 19*b* is dimensioned such that the open rim 25 in the open position is drawn against and in contact with the security ring 17. In the open position, the first and second retaining strips 19*a*, 19*b* are tensioned or elastically stretched. In order for the threaded part 15 to remain in the open position and not fold back, it is positioned below the second projection 71 and held by the second projection 71. In the open position, the threaded part 15 is also in contact with the support ring 72 of the container 13 (FIG. 3).

Since the second projection 71 is formed on the security ring 17 and is not formed on the threaded part 15, the web section 69 has no weaknesses which are attributable to the second projection. The security ring 17 is therefore sufficiently stable to be able to be pressed onto the container neck 29.

Since the closure cap 11 is rotationally symmetrical, it has a center point 73. The center point 73 lies in the imaginary plane between the open rim 25 and the security ring 17. The first end 39 and the third end 51 enclose a first opening angle 75 of at least 15 degrees and at most 40 degrees, or at least 20 and at most 25 degrees, with respect to the center point 73 as the apex. The second end 41 and the fourth end 53 enclose a second opening angle 77 of at least 220 degrees and at most 270 degrees, or at least 240 and at most 260 degrees, with respect to the center point 73 as the apex.

The first end 39 and the second end 41 enclose a third opening angle 79 of at least 30 degrees and at most 60 degrees, or of at least 40 and at most 50 degrees, with respect to the center point of the closure cap as the apex. The third end 51 and the fourth end 53 enclose a fourth opening angle 81 of at least 30 degrees and at most 60 degrees, or at least 40 and at most 50 degrees, with respect to the center point 73 as the apex. It goes without saying that the sum of the first, second, third, and fourth opening angles 75, 77, 79, 81 must be 360 degrees, since the first, second, third, and fourth opening angles have the circle center point 73 as the apex. By selecting the first, second, third, and fourth opening angles, it is possible for the first and second retaining strips 19*a*, 19*b* to have a certain length which enables the functions of the closure cap 11 described above in combination with the second projection 71.

Expediently, the third and fourth opening angles 79, 81 are of equal size, which is equivalent to the first and the second retaining strips 19*a*, 19*b* being of equal length. The first and the second retaining strips 19*a*, 19*b* are formed from the security ring 17.

According to the embodiment in FIGS. 1 or 6 and 7, a first or a second narrowing 83, 85 of the cross-section of the first or the second retaining strip 19*a*, 19*b* is provided at the second or the fourth end 41, 53. Due to the first and second narrowings 83, 85, the second or the fourth end 41, 53 can act as a joint.

In the embodiment according to FIGS. 2 through 5, the cross-section of the first and second retaining strips (19*a*, 19*b*) is constant along the length of the first or second retaining strip (19*a*, 19*b*). As a result, the first and the second retaining strips (19*a*, 19*b*) can be constantly stretched.

If the closure cap 11 is pressed onto the container neck 29, the pouring opening 33 is closed by the closure cap 11, and the closure cap 11 is in the closing position. When the threaded part 15 is unscrewed from the container neck 29, the first, second, third, and fourth predetermined breaking webs 47, 49, 59, 61 and the security webs 63 break. The security ring 17 rotates along with the threaded part 15. During unscrewing, the first and second retaining strips 19*a*, 19*b* can straighten. The second and the fourth ends 41, 53 act as an articulation as a result of the first and second narrowings 75, 77. The first and third ends 39, 51 are bendable, e.g., bendable outwards, because this simplifies the movement of the threaded part 15 into the open position, and the first and second retaining strips 19*a*, 19*b* can act more definedly as a hinge.

As already described above, after unscrewing, the threaded part 15 is folded away from the container neck 29 into the open position by locking the open rim 25 on the second projection 71. By selecting the first, second, third, and fourth opening angles 75, 77, 79, 81, the first and second retaining strips 19*a*, 19*b* have a length which allows the threaded part 15 to be unscrewed from the container neck 29 and held in the open position on the second projection 71. The length of the first and second retaining strips 19*a*, 19*b* is, in the process, to be precisely matched. If the length of the retaining strips is too long, the threaded part 15 is not held sufficiently firmly on the second projection 71, wobbles, and is not supported on the second projection 71. If the length of the retaining strips is too short, the threaded part 15 snaps back out of the open position and impedes the pouring out of filling material from the pouring opening 33.

In the open position, the threaded part 15 is captively held on the container 13 and is affixed to the container neck 29 in such a way that it does not project into the pouring opening 33 when liquid is poured out of the container 13. The first and the second holding straps 19*a*, 19*b* allow the threaded part 15 to be transferred into the open position in a forced folding movement after it has been unscrewed from the container neck 29. Due to the forced guidance and the second projection 71, only one open position exists, and not several. The length and cross-section of the first or the second retaining strip 19*a*, 19*b* are dimensioned in such a way that the first and the second retaining strips 19*a*, 19*b* are elastically tensioned in the open position of the threaded part 15. As a result, the threaded part 15 in the open position is drawn onto the container neck 29 and the second projection 71, and is held thereon in a wobble-free manner. The elastic pretensioning of the first and second retaining strips 19*a*, 19*b* also makes it possible for the threaded part to be transferred repeatedly from the open position into the closed position, and vice versa. As a result, the container neck 29 can be opened and closed several times, and after opening, the threaded part 15 is held in the open position in a stable and wobble-free manner each time.

FIGS. 6 through 8 show a third embodiment of the invention. In this embodiment of the invention, a groove 91 is provided on the first cylindrical shell 23. The groove 91 is oriented to be substantially parallel to the open rim 25 and has the shape of a straight depression. This means that the groove 91 does not describe a convex or concave arc relative to the first cylindrical shell 23, although this is also possible. It goes without saying that the first cylindrical shell 23 must have a sufficient thickness at least in the region of the groove 91 that it can have a corresponding depth, and the threaded part 15, by providing the groove 91, does not leak. A plurality of ribs 93 is formed on the outside of the first cylindrical shell 23. Such ribs are known and, in addition to design considerations, fulfill the purpose of making it easier to screw on and unscrew the threaded part 15 by means of increased friction when grasped. The length of the ribs 93 extends in the axial direction of the closure cap. The height of the ribs 93 extends in the radial direction of the threaded part 15. In addition, the height of the ribs 93 can increase in the direction of the bottom 21, whereby the threaded part 15 has the shape of a truncated cone. When ribs 93 are provided, the groove 91 is realized in that a U-shaped depression 95 is provided in each case on adjacent ribs 93. Starting from a central rib 93, the depth of the respective depressions 95 in the adjacent ribs 93 decreases to both sides. In this case, the groove 91 results from an intersection of two bodies, viz., the threaded part 15 with a "rod," which leaves the groove 91 as an impression.

The groove 91 serves to accommodate the support ring 72 in the open position of the threaded part 15, as shown in FIG. 8. It is therefore also conceivable for the groove 91 to have a shape that corresponds to an impression of the region of support ring 72 which cooperates with groove 91. In this embodiment of holding the threaded part 15 in the open position, no second projection 71 is provided. The threaded part 15 is therefore held in the open position by the first and second retaining strips 19*a*, 19*b* and the cooperation of the support ring 72 with the groove 91. The length of the retaining strips 19*a*, 19*b* is dimensioned such that they have a certain tension in the open position, and the groove 91 snaps into the support ring 72. As a result, the threaded part is held free of wobble in the open position.

However, it is also conceivable for the second projection 71 and the groove 91 to be formed or provided on the closure cap 11. In this case, the threaded part is held on the container neck 29 in a particularly stable manner in the open position, since, in the open position, the threaded part 15 is held in a form and/or force fit on the second projection 71 and on the support ring 72.

The projections 37 can be designed in accordance with the following description of FIGS. 9 and 10. This embodiment of the projections 37 is the content of the Swiss patent applications with application numbers 01467/19 and 01695/19, the priorities of which were claimed, and the disclosure contents of which are hereby incorporated into the present patent application. Slots 97 are provided on the security ring so as to be distributed over the circumference of the security ring 17. The slots 97 each have an upper edge 99 and a lower edge 101. The upper edge 99 is formed by a circular-arc-shaped section of the security ring 17. The lower edge 101 corresponds to the free rim of a wall section 103 inclined inwardly in the radial direction. Due to the internal inclination of the wall section 103, the lower edge 101 has a smaller radius than the security ring 17 and can thereby adjoin an abutment (annular projection 35) of the container neck 29 when the threaded part 15 is unscrewed from the container neck 29. The abutment is realized by the annular projection 35, which is formed below the outer thread 31 on the container neck 29. When the threaded part 15 is unscrewed, the lower edge 99 engages in a form fit on the projection 35, as a result of which the security ring 17 is reliably held on the annular projection 35 even under high axial forces.

Each wall section 101 has a first subsection 105 and two, second subsections 107. The first subsection 105 represents an inwardly-folded shell section and is designed to be flat. The second subsections 107 adjoin the inwardly-facing sides of the first subsection 105 and connect them to the security ring 17. The second subsections 107 can be designed to be curved or flat and face each other inclined inwardly. The lower edge 101 of the slot 97 corresponds to the free rims of the first subsection 105 and second subsections 107 and lies in a plane 109, which is shown in FIG. 10. The plane 109 is oriented to be perpendicular to the axis of rotation 110 of the container neck 29. These described design features of the wall section 103 have the advantage that the wall section 103 can rest with the entire lower edge 101 against the annular projection 35 and does not yield upwards like a barb under an axial traction. As a result, the security ring 17 is held non-detachably on the projection 35, or can be removed from the projection 35 only by being destroyed. A movement of the first subsection 105 inwards in the radial direction is prevented by providing the second subsections 107. However, a movement of the first subsection 105 outwards in the radial direction is possible. This movement is flexible, and, after being pressed radially outwards, the wall section 103 returns to its inwardly-inclined home position. This has the further advantage that the security ring 17 can be easily demolded and can be pressed together with the threaded part 15 with little force onto the container neck 29. As a result of the flexibility of the wall section 103, the demolding from an injection mold and the pressing onto the container neck 29 can take place without the risk of damaging the wall section 103.

The inclined wall sections 103 have a lesser wall thickness than the remaining security ring 17. FIG. 10 shows that the region of the lower edge 101 has the smallest wall thickness. The flexibility of the wall section 103 described above is thereby further improved radially outwards. The wall thickness of the wall section 103 increases linearly downwards, starting from the lower edge 101.

FIGS. 9 and 10 show the security ring 17 without the threaded part 15. FIGS. 9 and 10 clearly show that an annular bead 111 on which the upper edges 99 rest is formed above the slots 97 on the security ring 17.

FIG. 10 shows a first and second angle of inclination 113, 115. The first angle of inclination 113 indicates the inclination of the first subsection 105 with respect to the plane of the lower edge 101. The first angle of inclination 113 has a magnitude between 60 and 80 degrees, or between 65 and 75 degrees. The greater the first angle of inclination 113, the better the stability of the wall sections 103 with respect to vertical force effects or axial tensile forces caused by the unscrewing of the threaded part 15. However, the first angle of inclination 113 may not become too large, since otherwise the annular projection 35 cannot be sufficiently gripped from below.

The second angle of inclination 115 indicates the inclination of the slot 97 with respect to the plane of the lower edge 111. The connecting line 117, which represents the inclination of the slot 97, is a connection of the upper edge 99 to the lower edge 101 in a plane spanned by the axis of rotation 110 and the connecting line 117. The second angle of inclination 115 is enclosed by the connecting line 117 and the plane 109. The second angle of inclination 115 has a magnitude between 30 and 50 degrees, or between 35 and 45 degrees. The greater the second angle of inclination 115, the more easily the security ring 17 can be demolded.

An inwardly-projecting inner cone 87 (FIG. 4), e.g., in the form of a sealing cylinder or a sealing ring, is formed on the bottom 21 of the threaded part 15. The inner cone 87 is designed to cooperate in a sealing manner with the inner wall 89 of the container neck 29 in the closed position. The closure cap 11 can therefore act as a so-called cone sealer and reliably seals the container neck 29.

The closure cap 11 is made of a plastic. Such plastics include, inter alia, PP and HDPE.

The invention claimed is:

1. Closure cap for closing the pouring opening of a container, comprising:

a cylindrical threaded part with an open rim, a cylindrical shell and an inner thread formed on the inside of the shell, which can cooperate with an outer thread of a container neck of a container;

a security ring configured to be held to a first projection formed on the container neck and having an upper rim facing the open rim of the cylindrical threaded part when the cylindrical threaded part is in a closed position;

a plurality of security webs releasably connecting the security ring to the open rim;

a first retaining strip having a first end and a second end and a first rim and a second rim, wherein the first end is securely connected to the open rim of the threaded part, the second end is securely connected to the security ring, the first rim releasably connected to the open rim of the threaded part by at least one, first breaking web, and the second rim releasably connected to the security ring by at least one, second breaking web;

a second retaining strip having a third end and a fourth end and a third rim and fourth rim, wherein the third end is securely connected to the open rim of the threaded part, the fourth end is securely connected to the security ring, the third rim is releasably connected to the open rim of the threaded part by at least one, third breaking web, and the fourth rim is releasably connected to the security ring by at least one, fourth breaking web, wherein a semicircular-arc-shaped web section of the security ring is formed between the first end and the third end and the threaded part can be folded from a closed position, in which it closes the pouring opening, into an open position, in which it completely uncovers the pouring opening, and vice versa; and a second projection formed on an outer wall of the semicircular-arc-shaped web section, wherein the open rim, when in the open position, comes into contact with the second projection.

2. Closure cap according to claim 1, wherein the second projection is formed on the upper rim of the security ring facing the threaded part.

3. Closure cap according to claim 1, wherein the second projection is a step projecting radially outwards.

4. Closure cap according to claim 1, wherein the second projection has a height between 1 and 4 mm.

5. Closure cap according to claim 1, wherein the first and the third ends enclose a first opening angle of at least 15 degrees and at most 40 degrees with respect to a center point of the closure cap as an apex, and wherein the second and the fourth ends enclose a second opening angle of at least 220 degrees and at most 270 degrees with respect to the center point of the closure cap as the apex.

6. Closure cap according to claim 5, wherein an opening angle, which encloses the web section with the center point as the apex, substantially corresponds to the first opening angle.

7. Closure cap according to claim 5, wherein the first and second ends enclose a third opening angle of at least 30 degrees and at most 60 degrees, with respect to the center point of the closure cap as the apex.

8. Closure cap according to claim 7, wherein the third and the fourth ends enclose a fourth opening angle of at least 30 degrees and at most 60 degrees with respect to the center point of the closure cap as the apex.

9. Closure cap according to claim 8, wherein the third and the fourth opening angles are of equal size, as a result of which the first and the second retaining strips are of equal length.

10. Closure cap according to claim 1, wherein respective lengths of the first and the second retaining strips are dimensioned in such a way that they are tensioned in the open position, and the threaded part is held in the open position.

11. Closure cap according to claim 1, wherein respective cross-sections of the first and second retaining strips is constant along a respective length of the first or second retaining strip.

12. Closure cap according to claim 1, wherein a respective narrowing of a cross-section of the second end of the first retaining strip or the fourth end of the second retaining strip, a result of which the second or the fourth end can act as an articulation.

13. Closure cap according to claim 1, wherein the upper rim of the security ring defines a first recess for receiving the first retaining strip and a second recess for receiving the second retaining.

14. Closure cap according to claim 1, wherein the first and/or the second ends of the first retaining strip, and the third and/or the fourth ends of the second retaining strip, are bendable along respective predefined bending lines.

15. Closure cap according to claim 1, wherein a bottom of the threaded part is in a form of an inwardly-projecting inner cone and is configured to cooperate in a sealing manner with an inner wall of the container neck in the closed position.

16. Closure cap according to claim 1, wherein the first and second retaining strips have a width between 3 mm and 7 mm.

17. Closure cap according to claim 1, wherein the container neck is a standardized container neck having the outer thread and the first projection and the closure cap is configured to cooperate with the outer thread and the first projection of the standardized container neck.

18. Closure cap according to claim 1, wherein the closure cap is made of a plastic material consisting of PP or HDPE.

19. Closure cap according to claim 1, wherein the threaded part, the security ring, the first and second retaining strips, the plurality of security webs, and the at least first, second, third, and fourth breaking webs are formed as one piece.

20. Closure cap according to claim 1, wherein the security ring has a plurality of slots distributed over a circumference of the security ring, each of the plurality of slots having an upper edge and a lower edge, wherein the upper edge is formed by a semicircular-arc-shaped section of the security ring, and the lower edge is formed by a wall section inclined inwardly in a radial direction, and the lower edge forms an engaging projection, whereby the engaging projection engages the first projection in a form-fitting manner with the first projection.

21. Container closure, comprising:

a container body;

a container neck adjoining the container body;

an outer thread formed on the container neck;

a closure cap for closing a pouring opening provided within the container neck, the closure cap comprising:

a cylindrical threaded part having an open rim and an inner thread configured to cooperate with the outer thread of a container neck of the pouring element;

a security ring configured to be held on a first projection formed on the container neck;

a plurality of security webs releasably connecting the security ring to the open rim;

a first retaining strip having a first end and a second end and a first rim and a second rim, wherein the first end is securely connected to the open rim of the threaded part, the second end is securely connected to the security ring, the first rim is releasably connected to the open rim of the threaded part by at least one, first, breaking web, and the second rim is releasably connected to the security ring by at least one, second breaking web, and a second retaining strip having a third end and a fourth end and a third rim and fourth rim, wherein the third end is securely connected to the open rim of the threaded part, the fourth end is securely connected to the security ring, the third rim is releasably connected to the open rim of the threaded part by at least one, third breaking web, and the fourth rim is releasably connected to the security ring by at least one, fourth breaking web;

a semicircular-arc-shaped web section of the security ring is formed between the first and the third ends;

the threaded part can be folded from a closed position, in which it closes the pouring opening, into an open position, in which it completely uncovers the pouring opening, and vice versa; and a second projection formed on an outer wall of the semicircular-arc-shaped web section, wherein the open rim, when in the open position, comes into contact with the second projection.

22. Container according to claim 21, further comprising a support ring at a transition from the container neck to the container body, wherein the threaded part in the open position is in contact with the second projection and the support ring.

23. Closure cap for closing the pouring opening of a container, comprising:

a cylindrical threaded part with an open rim, a cylindrical shell and an inner thread formed on the inside of the shell, which can cooperate with an outer thread of a container neck of a container;

a security ring configured to be held to a first projection formed on the container neck and having an upper rim facing the open rim of the cylindrical threaded part when the cylindrical threaded part is in a closed position;

a plurality of security webs releasably connecting the security ring to the open rim;

a first retaining strip having a first end and a second end and a first rim and a second rim, wherein the first end is securely connected to the open rim of the threaded part, the second end is securely connected to the security ring, the first rim releasably connected to the open rim of the threaded part by at least one, first breaking web, and the second rim releasably connected to the security ring by at least one, second breaking web; and a second retaining strip having a third end and a fourth end and a third rim and fourth rim, wherein the third end is securely connected to the open rim of the threaded part, the fourth end is securely connected to the security ring, the third rim is releasably connected to the open rim of the threaded part by at least one, third breaking web, and the fourth rim is releasably connected to the security ring by at least one, fourth breaking web, wherein a semicircular-arc-shaped web section of the security ring is formed between the first end and the third end and the threaded part can be folded from a closed position, in which it closes the pouring opening, into an open position, in which it completely uncovers the pouring opening, and vice versa; and a support ring on the container neck, the cylindrical shell defining a groove configured to receive the support ring when the threaded part is in the open position.

24. Closure cap according to claim 23, wherein the groove is oriented to be substantially parallel to the open rim, wherein the groove has a shape of a straight depression.

25. Closure cap according to claim 24, further comprising a plurality of ribs on an outside of the first cylindrical shell, a length of each of the plurality of ribs extends in an axial direction and a height of each of the plurality of ribs extends in a radial direction of the threaded part.

26. Closure cap according to claim 25, wherein the groove is U-shaped and extends through a plurality of adjacent ribs of the plurality of ribs, wherein a depth of the groove on the plurality of adjacent ribs decreases in both directions from a central rib.

* * * * *